US010016327B2

(12) United States Patent
Hoijng

(10) Patent No.: US 10,016,327 B2
(45) Date of Patent: Jul. 10, 2018

(54) COFFIN FOR HOLDING AN INNER COFFIN AND HAVING A BASE AND A COVER

(71) Applicant: Rolandus Franciscus Beatrijs Marie Josef Hoijng, Vught (NL)

(72) Inventor: Rolandus Franciscus Beatrijs Marie Josef Hoijng, Vught (NL)

( * ) Notice: Subject to any disclaimer, the term of this patent is extended or adjusted under 35 U.S.C. 154(b) by 45 days.

(21) Appl. No.: 14/763,500

(22) PCT Filed: Jan. 27, 2014

(86) PCT No.: PCT/NL2014/050040

§ 371 (c)(1),
(2) Date: Jul. 24, 2015

(87) PCT Pub. No.: WO2014/116116

PCT Pub. Date: Jul. 31, 2014

(65) Prior Publication Data

US 2016/0000632 A1 Jan. 7, 2016

(30) Foreign Application Priority Data

Jan. 28, 2013 (NL) ..... 2010192

(51) Int. Cl.
*A61G 17/02* (2006.01)
*A61G 17/00* (2006.01)

(52) U.S. Cl.
CPC ..... *A61G 17/02* (2013.01); *A61G 17/001* (2017.05); *A61G 17/002* (2013.01); *A61G 17/004* (2016.11)

(58) Field of Classification Search
CPC ..... A61G 17/00; A61G 17/02; A61G 17/004; A61G 17/001; A61G 17/041; A61G 17/04; A61G 17/0405; Y10T 16/4701
(Continued)

(56) References Cited

U.S. PATENT DOCUMENTS 1,227,929 A * 5/1917 Ralston ..... A61G 17/04 16/424
3,295,179 A * 1/1967 Behrendt ..... A61G 17/00 27/35

(Continued)

FOREIGN PATENT DOCUMENTS

| | | |
|---|---|---|
| DE | 19853797 | 5/2000 |
| FR | 2957784 | 9/2011 |
| JP | 9-308659 | 12/1997 |

OTHER PUBLICATIONS

International Search Report and Written Opinion for PCT/NL2014/050040 dated Apr. 15, 2014.

(Continued)

*Primary Examiner* — William Miller
(74) *Attorney, Agent, or Firm* — Ladas & Parry, LLP

(57) ABSTRACT

A coffin is constructed to hold an inner coffin for holding the mortal remains therein or thereon. The inner coffin has a bottom, opposing first and second ends and opposing first and second sides extending in a longitudinal direction of the inner coffin between the first and second ends. The coffin comprises a base for supporting the inner coffin; and a cover to provide at least partial covering of the inner coffin when arranged on the base. The coffin allows displacement of the inner coffin over the base by allowing passage of the inner coffin from the base at one end or side. The coffin further allows access to at least one other one of the ends and sides of the inner coffin from lateral directions along a support plane comprising the bottom of the inner coffin for getting hold on the inner coffin to move it along the support plane over the base in the direction of the one of the ends and sides of the inner coffin.

8 Claims, 11 Drawing Sheets

(58) Field of Classification Search
USPC ..... 27/2, 35, 14, 27, 17; 16/424
See application file for complete search history.

(56) References Cited

U.S. PATENT DOCUMENTS 3,613,189 A * 10/1971 Kirby ..... A61G 17/04 27/35
4,177,543 A * 12/1979 Angermann ..... A61G 17/00 27/35
4,237,590 A * 12/1980 Work ..... A61G 17/00 27/2
4,265,006 A * 5/1981 Angermann ..... A61G 17/00 27/14
4,372,018 A * 2/1983 Miller, IV ..... A61G 17/00 27/27
4,788,757 A * 12/1988 Bethune ..... A61G 17/00 27/12
5,481,785 A * 1/1996 Minton ..... A61G 17/00 27/19
5,507,070 A 4/1996 Spyche, Jr. et al.
6,385,824 B1 * 5/2002 Schwartz ..... A61G 17/00 27/35
6,684,467 B1 * 2/2004 Walker ..... A61G 17/00 27/35
7,213,312 B2 * 5/2007 Foroni ..... A61K 31/7076 16/424
7,475,458 B1 * 1/2009 Gordon ..... A61G 17/02 27/35
8,127,414 B2 * 3/2012 Rankin ..... A61G 17/02 27/27
8,601,653 B1 * 12/2013 Agurcia ..... A61G 17/007 27/2
8,914,953 B1 * 12/2014 Thacker ..... A61G 17/0076 27/35

OTHER PUBLICATIONS

International Type Search Report and Written Opinion for NL2010192 dated Oct. 2, 2013.

* cited by examiner

COFFIN FOR HOLDING AN INNER COFFIN AND HAVING A BASE AND A COVER

CROSS-REFERENCE TO RELATED APPLICATION(S)

This application is the U.S. National Stage of International Patent Application No. PCT/NL2014/050040 filed on Jan. 27, 2014, which claims priority to Netherlands Patent Application No. 2010192 filed Jan. 28, 2013, the disclosures of which are incorporated in their entireties herein by reference.

FIELD OF THE INVENTION

The invention relates to a coffin for holding mortal remains of a deceased person, the coffin being constructed to hold an inner coffin constructed for holding the mortal remains therein or thereon, the inner coffin having a bottom, opposing first and second ends and opposing first and second sides extending in a longitudinal direction of the inner coffin between the first and second ends, the coffin comprising a base constructed and arranged for supporting the inner coffin; and a cover constructed and arranged such as to provide at least partial covering of the inner coffin when arranged on the base.

BACKGROUND OF THE INVENTION

The above coffins are known.

For example, FR 2957784 describes a coffin comprised of a base provided with three edges on which a lid can be positioned, wherein outlining of base and lid is obtained through said edges. Taking of the lid and positioning same is performed manually. The lid has to be separated from the base when handling mortal remains.

From DE 19853797 a coffin is known comprising an outer coffin with hingeable sides and ends, provided so as to enable removing or inserting an inner coffin containing mortal remains.

In general, these known coffins allow the inner coffin with the mortal remains to be separated from the coffin, so the coffin could be reused. After taking out of the coffin, the inner coffin can then be further handled in, for instance, a crematory. A coffin is known in which the coffin allows access to and taking out of the inner coffin from the coffin at an end of the inner coffin along the longitudinal direction of the coffin.

However, such access to the inner coffin is troublesome. It provides only a difficult access to the inner coffin and it proves difficult to pull the inner coffin out of the coffin, especially with inner coffins that are constructed in a lightweight manner and of lightweight and cost effective materials, such as cardboard, this poses a problem. Such inner coffins may become damaged, which one very much would like to prevent.

Coffins providing such access to the inner coffin also pose limitations on the overall design and lay-out of the coffin. For funeral services one would like to have a large freedom in the design and aesthetics of the coffin, and the choice of materials for the coffin. Such freedom is rather limited for known coffins.

SUMMARY OF THE INVENTION

It is an object of the invention to provide a coffin that allows easy access to and displacement of an inner coffin form the coffin.

It is another or alternative object of the invention to provide a coffin that can hold an inner coffin and that provides a large freedom in the design and lay-out of and choice of materials for the coffin, while still allowing an easy access to and displacement or separation of an inner coffin from the coffin.

It is yet another or alternative object of the invention to provide a coffin from which an inner coffin can be separated while providing hygiene in that the mortal remains will not come into contact with the coffin.

It is yet another object of the invention to provide a coffin that can easily be reused after a funeral service. This will at least limit the amount of material to be buried or burned in a crematory, and also be cost-efficient.

At least one of these objects is achieved by a coffin wherein at least part of the cover is translatable in an upward direction with respect to the base, the coffin comprising a lifting mechanism constructed and arranged for lifting and lowering of the at least part of the cover with respect to the base. Such embodiment occupies minimum space around the footprint of the coffin for opening the cover. It provides therefore very easy access to all sides and ends of the inner coffin and displacement of the inner coffin. Further, it gives a very large freedom in the design and lay-out of the cover of the coffin. The lifting mechanism constructed and arranged for lifting and lowering of the at least part of the cover with respect to the base, provides assistance in handling the cover.

At least one further object is achieved by a coffin for holding remains of a deceased person, the coffin being constructed to hold an inner coffin constructed for holding the mortal remains therein or thereon, the inner coffin having a bottom, opposing first and second ends and opposing first and second sides extending in a longitudinal direction of the inner coffin between the first and second ends, the coffin comprising a base constructed and arranged for supporting the inner coffin; and a cover constructed and arranged such as to provide at least partial covering of the inner coffin when arranged on the base, wherein the coffin is constructed to allow displacement of the inner coffin over the base by allowing passage of the inner coffin from the base at one of the first and second ends and the first and second sides of the inner coffin, and the coffin is further constructed such as to allow access to at least one other one of the first and second ends and the first and second sides of the inner coffin from lateral directions along a support plane comprising the bottom of the inner coffin for getting hold on the inner coffin to move it along the support plane over the base in the direction of the one of the first and second ends and the first and second sides of the inner coffin.

In a first embodiment to which the invention is directed, when the cover has been translated in an upward or open position, the construction of the coffin allows the inner coffin to be displaced over the base at its first side in the transversal direction (perpendicular to the longitudinal direction) in the direction of the first side. Alternatively, the inner coffin can be displaced in the transversal direction in the direction of the second side. To effect displacement of the inner coffin, the inner coffin can be pushed at the side opposite the side towards which the inner coffin is displaced. As a consequence, one can get hold on the inner coffin at the sides to displace the inner coffin in a direction perpendicular to the longitudinal direction LD.

In a second embodiment to which the invention is directed, when the cover has been translated in an upward or open position, the construction of the coffin allows the inner coffin to be displaced over the base at its first end in the longitudinal direction in the direction of the first end. Alternatively, the inner coffin can be displaced in the longitudinal direction in the direction of the second end. To effect displacement of the inner coffin, the inner coffin can be pushed at the end opposite the end towards which the inner coffin is displaced. Alternatively and/or additionally, one can get hold on the inner coffin at the sides to displace the inner coffin in a longitudinal direction LD.

In an advantageous embodiment the one of the first and second ends and the first and second sides of the inner coffin is the first end allowing movement of the inner coffin along the longitudinal direction of the inner coffin along the support plane over the base in the direction of the first end. This allows easy displacement of the inner coffin from the coffin for further processing in especially a crematory.

In a further advantageous embodiment the one of the first and second ends and the first and second sides of the inner coffin is the first side allowing movement of the inner coffin along the lateral direction of the inner coffin along the support plane over the base in the direction of the first side. This allows easy displacement of the inner coffin from the coffin for further processing in especially a crematory.

In a preferred embodiment at least part of the cover is movable in an upward direction with respect to the base. Such embodiment allows very good and easy access to the inner coffin for displacement thereof.

In another preferred embodiment the at least part of the cover is translatable in an upward direction with respect to the base. Such embodiment occupies minimum space around the footprint of the coffin for opening the cover. It provides therefore very easy access to all sides and ends of the inner coffin and displacement of the inner coffin. Further, it gives a very large freedom in the design and lay-out of the cover of the coffin.

In a preferred embodiment the coffin comprises a lifting mechanism constructed and arranged for lifting and lowering of the at least part of the cover with respect to the base, which provides assistance in handling the cover.

Preferably, the lifting mechanism comprises linked support arms that support the at least part of the cover on the base such that an upward or downward force exerted on the cover provides lifting and lowering, respectively, of the part of the cover supported by the lifting mechanism for easy and efficient handling of the cover.

In another embodiment the at least part of the cover is rotatable for easy and efficient upward movement of the cover.

Preferably, the at least part of the cover is rotatable with respect to an axis that is at least substantially along the longitudinal direction of the inner coffin, which gives easy and efficient handling of a rotatable cover about such axis.

In a preferred embodiment the coffin comprises a spring arrangement for at least partially compensating for a weight of the part of the cover (120) that is movable in an upward direction, which provides that only limited force need be exerted on the cover for opening and closing. It further provides that the cover can remain in the open position without additional measures.

In an efficient embodiment the spring arrangement comprises a fluid-filled compression spring, especially a gas-filled spring.

In an advantageous embodiment the spring arrangement comprises a pump arrangement for providing fluid to or release fluid from the fluid-filled compression spring, which provides an efficient means of lifting and lowering of the cover.

In another embodiment at least part of the cover and the base are movable with respect to one another in a lateral direction along the support plane, which provides easy and good access to the inner coffin for displacement thereof.

In an efficient embodiment the at least part of the cover and the base are movable with respect to one another in a direction transverse to the longitudinal direction of the inner coffin.

In an advantageous embodiment the coffin comprises at least one actuator arranged for moving the at least part of the cover and the base with respect to one another to allow actuated displacement of the cover. No manual force is therefore required. This is efficiently achieved when the at least one actuator comprises an electric motor.

In another efficiently achieved embodiment the cover comprises a door arrangement to allow access to the inner coffin for getting hold on the inner coffin from the lateral direction. In an embodiment the cover comprises a door at a location corresponding to the second end of the inner coffin. In another embodiment the cover comprises a door at a location corresponding to one or both of the first and second sides of the inner coffin. In yet another embodiment the cover comprises a door at a location corresponding to the first end of the inner coffin to allow passage of the inner coffin. In still another embodiment the cover comprises a door at a location corresponding to at least one of the first and second side of the inner coffin to allow passage of the inner coffin.

Yet further there is provided a coffin for holding mortal remains of a deceased person, the coffin being constructed to hold an inner coffin constructed for holding the mortal remains therein or thereon, the inner coffin having a bottom, opposing first and second ends and opposing first and second sides extending in a longitudinal direction of the inner coffin between the first and second ends, the coffin comprising a base constructed and arranged for supporting the inner coffin; and a cover constructed and arranged such as to provide at least partial covering of the inner coffin when arranged on the base.

In an advantageous embodiment the base is provided with a roller arrangement constructed and arranged to allow displacement of the inner coffin with respect to the base to provide an easy and efficient displacement with effort of the inner coffin over the base. Such roller may preferably be a ball arrangement.

In another advantageous embodiment at least one of the base and the cover comprises a cooling element holding arrangement for holding cooling elements for cooling of the mortal remains, which provides a means to incorporate or replace such cooling elements when required.

Advantageously, at least one of the base and the cover comprises cooling elements for cooling of the mortal remains, which provides that the mortal remains can be held in good condition without the need of any external provisions.

According to a preferred embodiment of the coffin according to the invention, the cover comprises receiving means for receiving exchangeable wall panels, at least partially positioned at at least one of opposing first and second ends and opposing first and second sides extending in a longitudinal direction of the inner coffin between said first and second ends. This allows one to easily exchange wall panels so as to yield another appearance of the coffin. For example, a set of wall panels comprising a picture or the like of the deceased person may be provided.

In the coffin according to the invention, said receiving means for receiving said wall panels may be comprised of U-shaped ducts, a first duct being provided at a position relatively close to the base and another duct being positioned at a top side relatively further away from the base, such that openings of said ducts are directed towards each other for receiving an exchangeable side wall. This allows a quick replacement of said wall panels.

In the coffin according to the present invention, said base may comprise near its first end an elevation, said inner coffin comprising near its end an elevated bottom portion, such that the bottom side of the inner coffin is supported by the base. By providing this elevated bottom, a separate elevation inside the inner coffin may be left out, whereas the upper body portion of the deceased person is in a pleasant position.

So as to ease handling of the inner coffin, the inner coffin is provided with handles, wherein said coffin's opposing first and second ends or said coffin's opposing first and second sides are provided with slotted holes, said handles being embodied with a central body, a first body part extending from said central body in a first plane therefrom in a first direction and a second body part extending from said central body in a second plane therefrom and in a second, opposite direction, said first and second plane being parallel and spaced apart at a distance substantially equal to the thickness of said coffin's wall, said first body part being designed to be inserted from the outside of said inner coffin through said hole, such that said central body is positioned in said hole, said first body part being positioned against said coffin wall at its inside and said second body part being positioned against said coffin wall at its outside and said grip being positioned at a distance from said coffin wall at its outside. This allows easy handling when inserting the handles in the slotted holes whereas the handles can be easily removed from the coffin, for example after the inner coffin has been placed inside the outer coffin or has been removed therefrom, or for example when the coffin is cremated.

In this embodiment, it is especially preferred if said first body part is positioned at a position relatively closer to the base than said second body part.

So as to enable a fast and secure closing of the lid of the inner coffin, said inner coffin comprises a base and walls, said inner coffin being closed off by a lid, said lid comprising a through hole covering at least part of one of said coffin's walls and extending at both sides of said wall, said wall comprising a recess at a position below said through hole in said lid, a retaining clip being positionable in said through hole, wherein a main body part of said clip is positioned on said lid directed away from said wall, said retaining clip further comprising two parallel legs and protrusions at each leg, such that when inserted in said lid's hole, said legs are positioned against opposite sides of said wall, said protrusions being at least partly received within said recesses.

In another embodiment, at least one of the objects is achieved by a mortal remains holding and handling method for holding and handling mortal remains of a deceased person, the method comprising providing the mortal remains in or on an inner coffin having a bottom, opposing first and second ends and opposing first and second sides extending in a longitudinal direction of the inner coffin between the first and second ends; providing the inner coffin on a base of a coffin constructed to hold the inner coffin; providing a cover of the coffin over the inner coffin; providing the coffin to a location for further handling of the mortal remains, such as in a crematory; providing a passage for the inner coffin from the base at one of the first and second ends and the first and second sides of the inner coffin; providing access to at least one other one of the first and second ends and the first and second sides of the inner coffin from lateral directions along a support plane comprising the bottom of the inner coffin for getting hold on the inner coffin to move the inner coffin from the base; and moving the inner coffin along the support plane over the base in the direction of the one of the first and second ends and the first and second sides of the inner coffin.

Advantageously, the one of the first and second ends and the first and second sides of the inner coffin is the first end allowing movement of the inner coffin along the longitudinal direction of the inner coffin along the support plane over the base in the direction of the first end.

Preferably, at least part of the cover is moved in an upward direction with respect to the base in steps of providing a passage for and access to the inner coffin.

In a preferred embodiment the at least part of the cover is translated in the upward direction with respect to the base.

In another embodiment the at least part of the cover is rotated.

In yet another embodiment the at least part of the cover and the base are moved with respect to one another in a lateral direction along the support plane.

Preferably, the at least part of the cover and the base are moved with respect to one another in a direction transverse to the longitudinal direction of the inner coffin.

BRIEF DESCRIPTION OF THE DRAWINGS

Embodiments of the invention will further be described with reference to the accompanying drawings, in which like or same reference symbols denote like, same or corresponding parts, and in which.

DETAILED DESCRIPTION OF EMBODIMENTS

Figure 1:
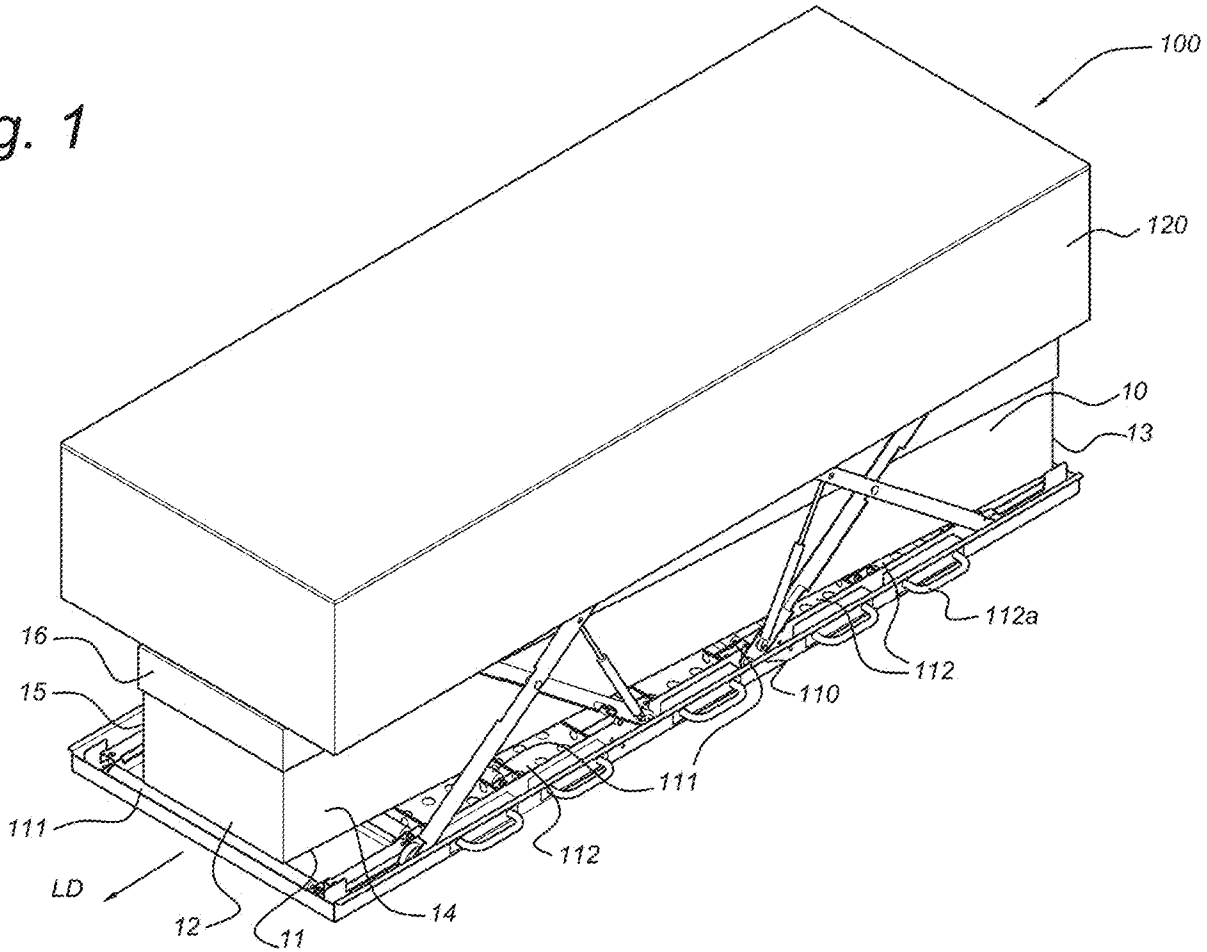
FIG. 1 shows a perspective view of a coffin according to the invention with an inner coffin and its cover in a lifted-up position.

A coffin 100 having a base 110 and a cover 120 is depicted in FIG. 1. An inner coffin 10 is provided on the base, and the cover is shown in a lifted position. Mortal remains of a deceased person can be provided in the inner coffin 10. The inner coffin can be manufactured in a simple and cost-effective manner, and of a material that is well compatible with processing in a crematory, while the coffin 100 (excluding the inner coffin) can be provided in any desired shape and of any material. The inner coffin 10 has a (liquid-tight) bottom 11, opposing first and second ends 12, 13 and opposing side faces 14, 15 that extend in a longitudinal direction LD between the ends 12, 13. The inner coffin as shown also has a lid 16.

The coffin 100 holds the inner coffin 10 on its base 110 and covers the inner coffin through its cover 120. The embodiment shown completely covers the inner coffin, but alternative embodiments may provide a partial cover of the inner coffin. The cover 120 of the coffin 100 can be moved in an upwards direction by lifting up to expose the inner coffin. When the cover 120 has been translated in an upward or open position, the construction of coffin 100 allows the inner coffin to be displaced over the base 110 at its first end 12 in the longitudinal direction LD in the direction of the first end 12. Alternatively, the inner coffin can be displaced in the longitudinal direction in the direction of the second end 13. To effect displacement of the inner coffin, the inner coffin can be pushed at the end opposite the end towards which the inner coffin is displaced. Alternatively and/or additionally, one can get hold on the inner coffin at the sides 14, 15 to displace the inner coffin in a longitudinal direction LD towards first end 12 or second end 13. In a closed position of the cover the inner coffin is held in place by the cover. Cover 120 has a lid part 120*a* that can be opened or removed so that a deceased person in the coffin is visible during a lie in state at, for instance, a funeral ceremony, mortuary or at home.

In an alternative embodiment to which the invention also specifically is directed, when the cover 120 has been translated in an upward or open position, the construction of coffin 100 allows the inner coffin to be displaced over the base 110 at its first side 14 in the transversal direction in the direction of the first side 14. Alternatively, the inner coffin can be displaced in the transversal direction in the direction of the second side 15. To effect displacement of the inner coffin, the inner coffin can be pushed at the side opposite the side towards which the inner coffin is displaced. As a consequence, one can get hold on the inner coffin at the sides 14, 15 to displace the inner coffin in a direction perpendicular to the longitudinal direction LD.

Figure 2:
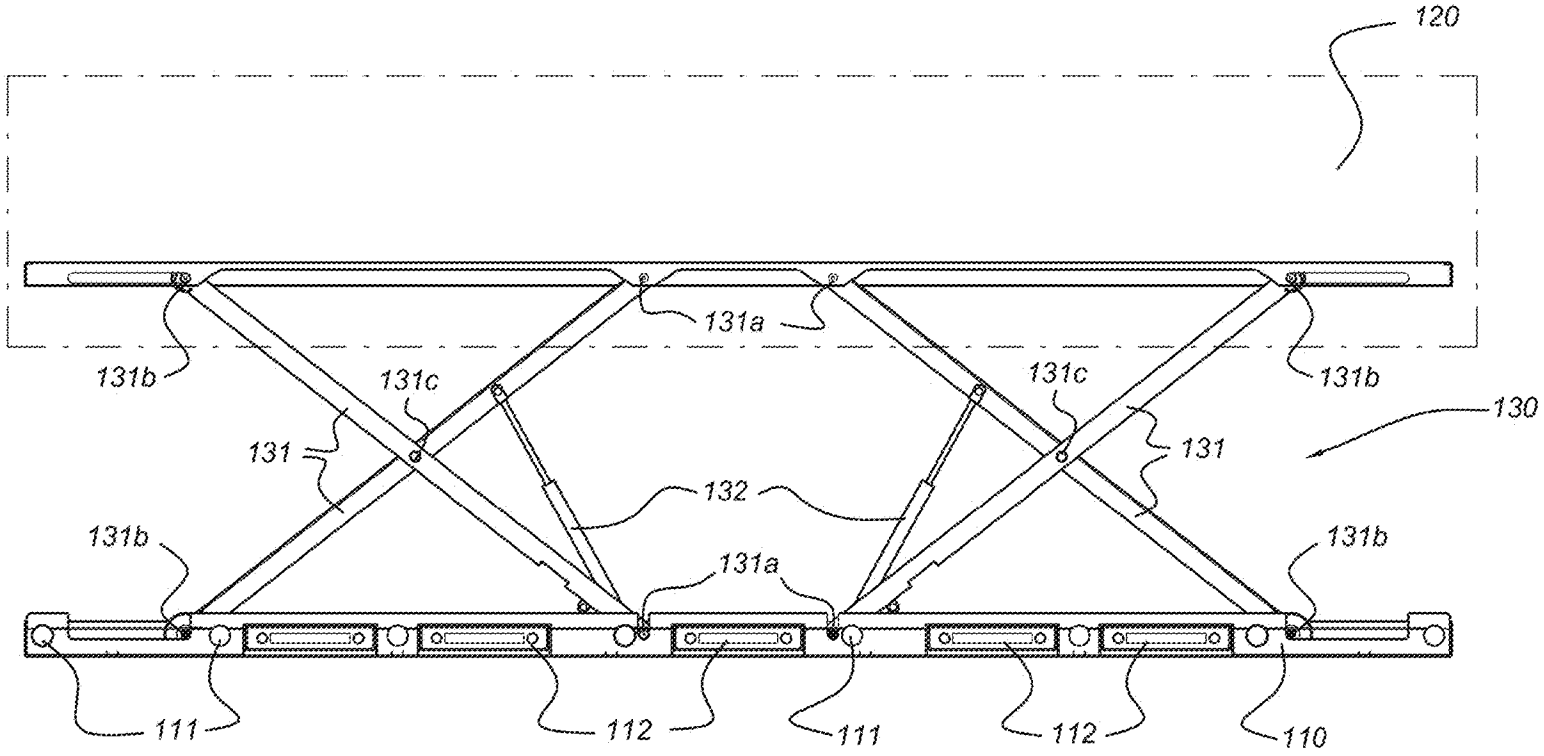
FIG. 2 shows a side view of the coffin of FIG. 1, especially of the lifting mechanism.

The cover 120 is translated in upward and downward directions relative to the base 110 with the aid of lifting mechanism 130, which is shown in more detail in FIG. 2. The lifting mechanism comprises linked support arms 131. The arms 131 of the embodiment of FIG. 1 has ends 131*a* that are connected in a hinged manner to either base 110 or cover 120 at a fixed position. The other ends 131*b* of the arms are connected in both a hinged and slideable manner to either the base or the cover. The ends 131*b* can slide in elongated slots provided in both base and cover (or a frame 124 as part of the cover). The arms 131 are mutually linked at positions 131*c* by hinges. The lifting mechanism 130 further comprises a spring element embodied as a gas-filled compression spring 132, which compensates for the weight of the cover. The cover 120 can be pushed upwards at an arbitrary position. The lifting mechanism will ensure that the whole cover 120 is then lifted upwards. The gas-filled springs 132 ensure that lifting up and down is carried out without much effort, and the cover will remain in an open position by the action of the gas-filled springs.

The lifting mechanism or arrangement 130 is provided at both sides of the coffin such that it is alongside sides 14, 15 of the inner coffin 10 when provided on the base 110. The lifting mechanism may alternatively be provided at the ends of the coffin such that it is alongside ends 12, 13 of the inner coffin when provided on the base 110. The inner coffin 10 may then be displaced from the base in a direction transverse to the longitudinal direction in a direction of one of both sides of the inner coffin. The inner coffin can be displaced by pushing at the opposing side and/or by getting hold on the inner coffin at one or both of its ends 12, 13.

The coffin 100 allows passage of the inner coffin from the base 110 when having moved the cover 120 in an upwards direction. The inner coffin may be passed of the base in a direction of one of the first and second ends 12, 13 and the first and second sides 14, 15, while getting hold on the inner coffin at at least one other one of the first and second ends and first and second sides. The bottom 11 of the inner coffin 10 passes through a virtual support plane (not shown) along a top side of the base 110. Lifting of the cover 120 with respect to the base 110 allows getting hold on the inner coffin from lateral directions along the support plane, and allows passage of the inner coffin of the base along the support plane in a longitudinal direction.

Figure 3:
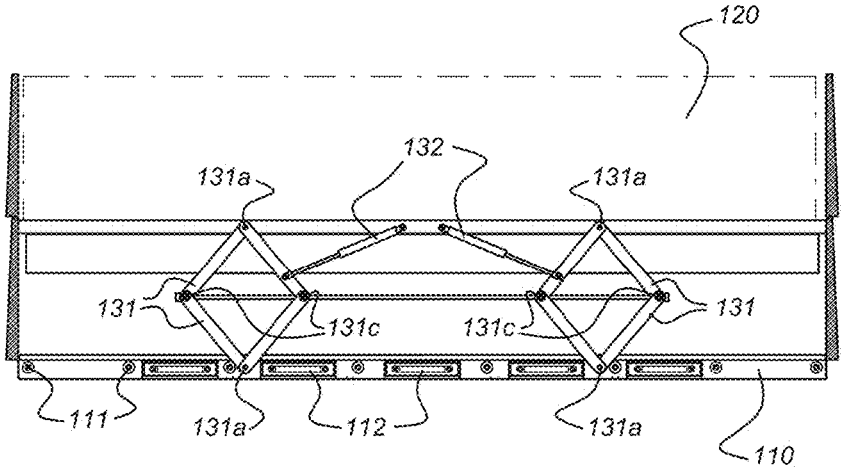
FIG. 3 shows a side view of another embodiment of a coffin according to the invention with another type of lifting mechanism.

An alternative embodiment of a coffin, especially of the lifting mechanism 130, is shown in FIG. 3. The figure shows another configuration of linked arms 131 connected in a hingeable manner at an end 131*a* at either base 110 or cover 120. Ends 131*c* of the arms are mutually linked and further interconnected by a rod 131*d*. Such construction of the lifting mechanism 130 also allows lifting of the whole cover by exerting an upwards force at an arbitrary location of the cover. Gas-filled compression springs again compensate for a weight of the cover. The weight compensation may in all embodiments be an undercompensation (meaning that not the whole weight is compensated), an overcompensation (meaning that an upwards force by the springs 132 is more than the weight of the cover 120 in an open position of the cover) or a substantially exact compensation. The lay-out of the lifting mechanism may be further such that the cover is held in the closed downward position by the action of the gas-filled springs 132. Opening and closing only requires a limited external force. The lifting mechanism can be configured such that the cover 120 is held in a stable intermediate position between open and closed positions by the lifting mechanism. A lock may be provided between base 110 and cover 120 to prevent unallowed opening of the cover.

Figure 4:
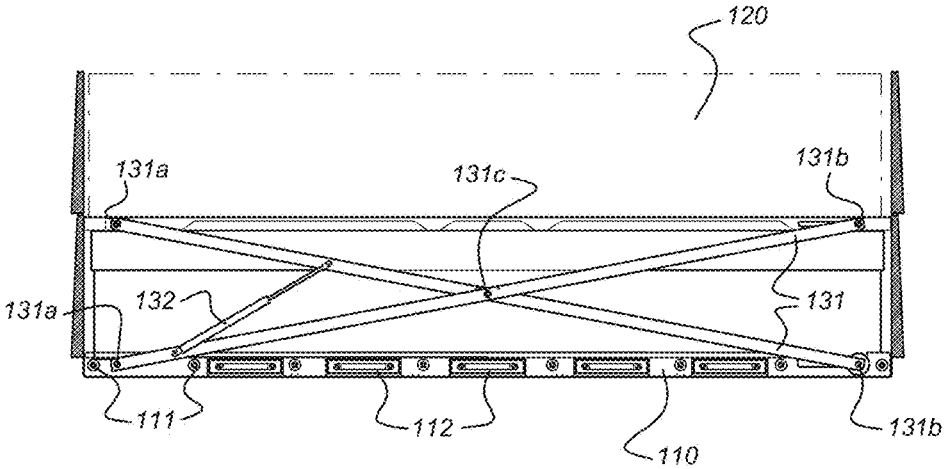
FIG. 4 shows a side view of yet another embodiment of a coffin according to the invention with yet another type of lifting mechanism.

Yet another embodiment of a coffin, especially of the lifting mechanism 130, is shown in FIG. 4. The figure shows only two arms 131 at one side of a location for the inner coffin. An end 131*a* is connected in a hingeable manner at either base 110 or cover 120, and an opposing end 131*b* is connected in both a hingeable and slideable manner at either cover or base, respectively. The arms are hingeably connected at locations 131*c*. Again a gas-filled spring 132, more generally a fluid-filled spring, is provided as in the above embodiments.

Figure 5A:
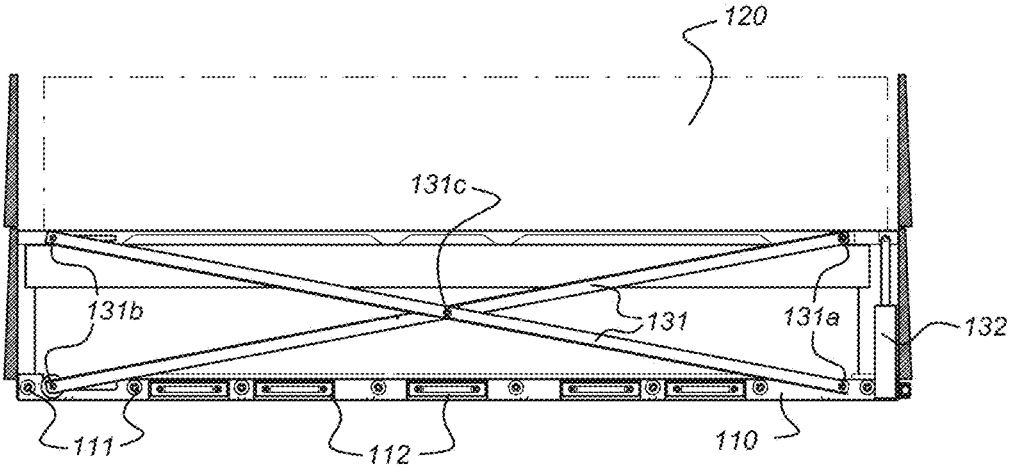
FIGS. 5*a* and 5*b* show a side view and front view, respectively, of yet another embodiment of a coffin according to the invention with yet another type of lifting mechanism.
Figure 5B:
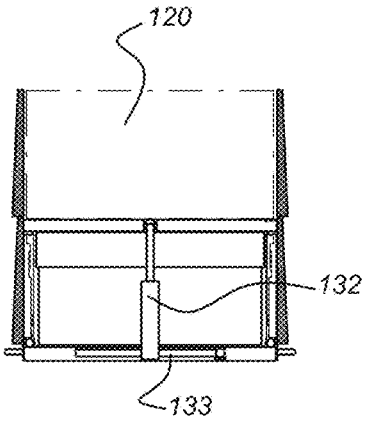

A variation of the embodiment of FIG. 4 is shown in FIGS. 5*a* and 5*b*. The gas-filled spring 132 of this embodiment is provided at a position next to a location of an end of the inner coffin on the base 110. The hydraulic cylinder of the fluid-filled spring 132 is connected to a pump arrangement embodied as a hydraulic hand-driven pump 133 for lifting and lowering of the cover 120. The pump 133 can be provide fluid to the fluid-filled spring to lift to cover and release fluid from the fluid-filled spring to lower the cover. The presence of fluid-filled spring 132 in the location shown still allows access to the inner coffin when provided on the base 110. The fluid-filled spring 132 and hand-driven pump 133 are also shown in FIG. 6, which presents a top view of base 110.

Figure 6:
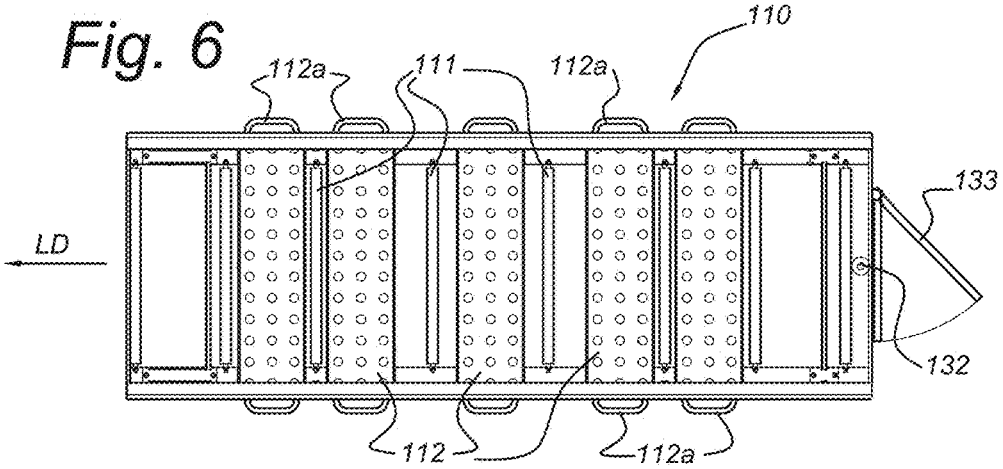
FIG. 6 shows a top view on a base of a coffin according to the invention, especially of the coffin according to FIGS. 5*a* and 5*b;*

The top view of the base 110 in FIG. 6 also applies to the embodiments disclosed with reference to FIGS. 1 to 4, although fluid-filled spring 132 and hand-driven pump 133 would not show for these embodiments. Base 110 comprises a roller arrangement having rollers 111 that allow easy displacement of an inner coffin positioned on these rollers in the longitudinal direction LD. The roller arrangement can be embodied in a different manner as well.

The base additionally has pockets or drawers 112 for receiving cooling elements. The cooling elements are provided with handles 112*a* for easy entry into and taking out of the pockets 112. The cooling elements allow cooling of the mortal remains of a deceased person when present in an inner coffin 10 within the coffin 100. The cooling elements can be connected to a mains for keeping them at a low temperature. They may also be provided cold into the pockets and replaced when not being cold enough. The embodiment shown has cooling elements that can be taken out or replaced. One can also envisage cooling elements integral with the base 110. Cooling elements may also be provided alternatively and/or additionally in the cover 120 as well.

The construction of the coffin is such that lifting mechanism and cooling arrangement, so the technical parts of the coffin, are not visible in an open position of lid part 125 of the cover 120 when the inner coffin is in place. The base can be provided on a platform for carrying the coffin, which platform can keep the cooling arrangement out of sight. The base can be provided in an integral manner with such platform. The platform can also be configured as a carriage having wheels for moving the coffin. A mechanism can be provided that allows such wheels and support to fold into and out of the basis or a platform connected to the basis. The coffin is used for transport of the mortal remains and for presenting the deceased person at a lie in state or funeral ceremony.

Figure 7:
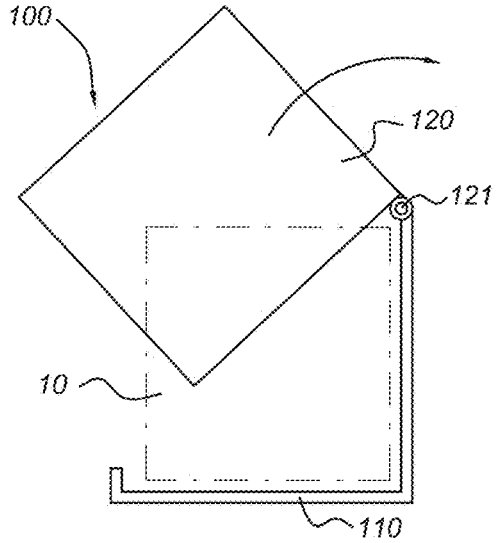
FIG. 7 shows a schematic front view of a yet another embodiment of a coffin according to the invention.

An embodiment of a coffin 100 of which the cover 120 is rotated in an upwards direction with respect to the base 110 is shown in FIG. 7. The cover rotates about an axis 121 that is arranged in a longitudinal direction, which extends perpendicular to the plane of the drawing. A lifting arrangement in an adapted version as disclosed with respect to embodiments described with reference to FIGS. 1 to 5 can be employed with the embodiment of FIG. 7 to lift and lower cover 120. A lifted cover 120 allows inner coffin 10 to be displaced towards one of its ends along its longitudinal direction that is perpendicular to the plane of the drawing by pushing against the opposing end. Additionally and/or alternatively, the inner coffin can be accessed from a lateral direction from the left-hand side of the figure to displace the inner coffin from the base 110. The base is provided with rollers in a manner equivalent to the base as shown in FIG. 6 for displacement in the longitudinal direction of the inner coffin from the base. Alternatively, the rollers of the base can be arranged such that the inner coffin can be displaced in a direction transverse to its longitudinal direction for displacement from the base out of the coffin.

Figure 8:
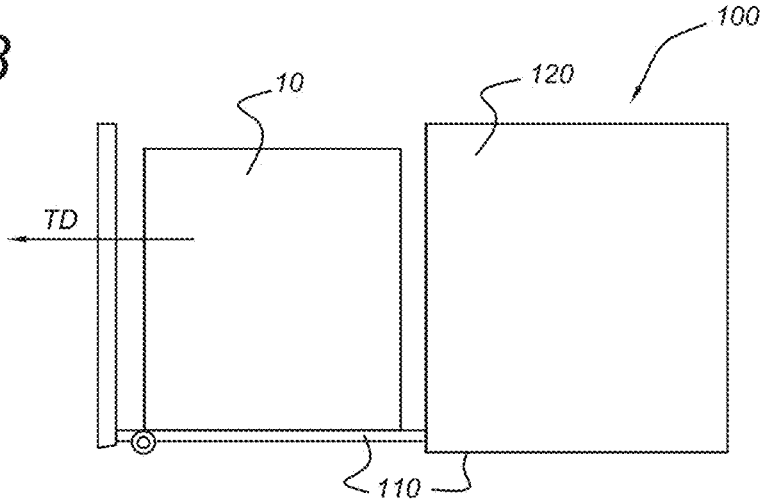
FIG. 8 shows a schematic front view of a yet another embodiment of a coffin according to the invention.

Yet another embodiment of coffin is depicted in FIG. 8. The inner coffin 10 is shown to be positioned on the base 110 that can be moved relative to the cover 120 in a drawer-like manner in the left-hand direction TD in the figure. The base is provided with rollers in a manner equivalent to the base shown in FIG. 6 for displacement in the longitudinal direction of the inner coffin from the base. In an alternative embodiment the cover 120 can be displaced relative to the base 110 to expose the inner coffin to allow its displacement from the base. In yet another alternative embodiment the cover can be displaced (wholly or partly) with respect to the base 110 in the longitudinal direction of the inner coffin to expose the inner coffin, after which the inner coffin can be accessed and displaced from the base in either the longitudinal direction of the inner coffin or a direction TD transverse thereto.

Figure 9A:
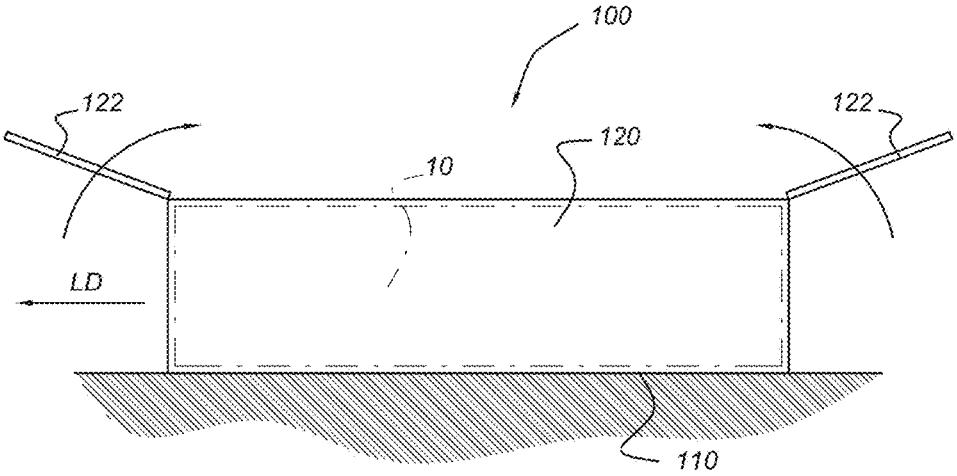
FIG. 9*a* shows a schematic side view of a yet another embodiment of a coffin according to the invention.
Figure 9B:
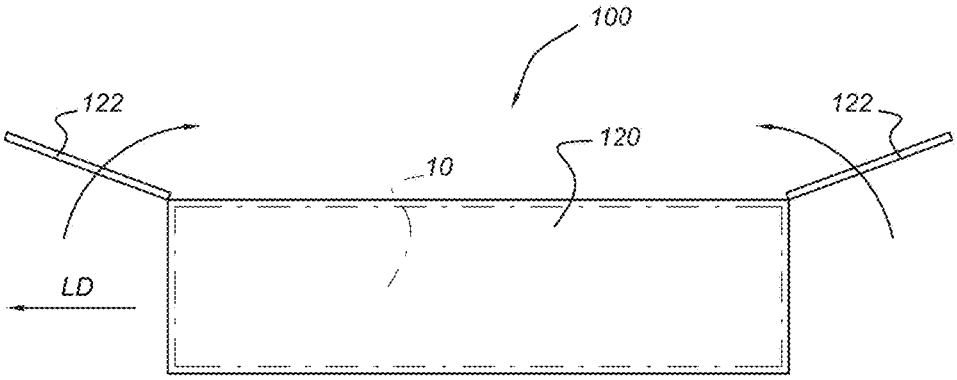
FIG. 9*b* shows a schematic top view of a yet another embodiment of a coffin according to the invention.

Yet other embodiments of a coffin 100 are shown in FIGS. 9*a* and 9*b*. FIG. 9*b* shows a schematic side view of a coffin with a base 110 and a cover 120 having a door 122 at both its ends that correspond to ends of the inner coffin 10 when provided in the coffin. The doors 122 of the embodiment in FIG. 9*a* open in an upwards direction. FIG. 9*b* shows a top view of an alternative embodiment in which the doors 122 open sideways. In both the embodiments of FIGS. 9*a* and 9*b* the inner coffin can be displaced from the base 110 of the coffin at one end, and can be accessed from the other end to allow to get hold on the inner coffin for displacement of the inner coffin from the base. In yet further alternative embodiments another or alternative door is provided at one or both sides of the cover for access to the inner coffin and/or displacement of the inner coffin from the base.

In further embodiments the above embodiments comprise one or more actuators for opening and closing of the cover or parts thereof. An electric motor would be an example of such an actuator.

The invention is also embodied by a corresponding mortal remains holding and handling method for holding and handling mortal remains of a deceased person. The method comprises providing the mortal remains in or on the inner coffin; providing the inner coffin on the base 110 of the coffin 100; and providing the cover 120 of the coffin over the inner coffin; providing the coffin to a desired location in, for instance, a church or funeral home during a funeral ceremony or at home. During the lie in state at a ceremony, a mortuary or at home a lid part 120*a* of the cover may be removed to allow a view on the deceased person. After that the coffin is provided to a location for further handling of the mortal remains, such as in a crematory. At that location for further handling the method comprises providing a passage for the inner coffin from the base at one of the first and second ends 12, 13 and the first and second sides 14, 15 of the inner coffin; providing access to at least one other one of the first and second ends 12, 13 and the first and second sides 14, 15 of the inner coffin from lateral directions along a support plane comprising the bottom 11 of the inner coffin for getting hold on the inner coffin 10 to move the inner coffin from the base; and moving the inner coffin along the support plane over the base 110 in the direction of the one of the first and second ends and the first and second sides of the inner coffin. Further embodiments of the method are equivalent to any embodiments of the coffin as disclosed.

Figure 10:
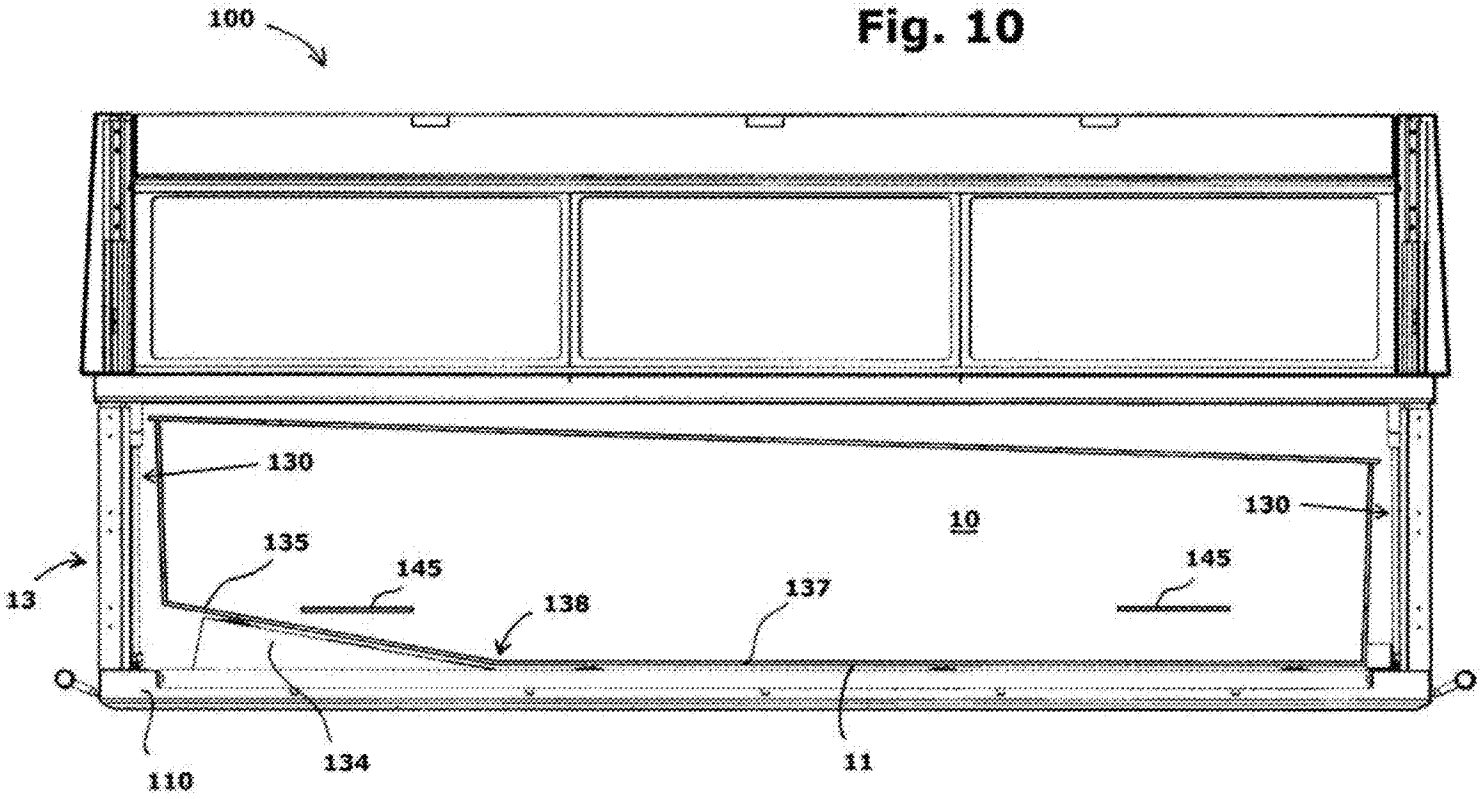
FIG. 10 shows a schematic side view of a coffin according to the invention.

In FIG. 10 a schematic side view of a coffin 100 according to a preferred embodiment of the present invention is shown. Coffin 100 comprises lifting mechanisms at end 12, 13, so as to enable a removal of the inner coffin 10 at any of its sides 14, 15. At end 13, base 110 is provided with an elevated part. Inner coffin 10 is provided with a corresponding elevation 135. So as to obtain this elevation 135, bottom 11 of inner coffin 10 comprises a regular, flat part 137, which at nod 138 continues in elevated part 135. As can be clearly seen in FIG. 10, lifting mechanism 130 is provided at both ends 12, 13 of coffin 100, so as to leave the sides 14, 15 of coffin 100 clear for easy removing of inner coffin 10 from coffin 100.

Figure 11:
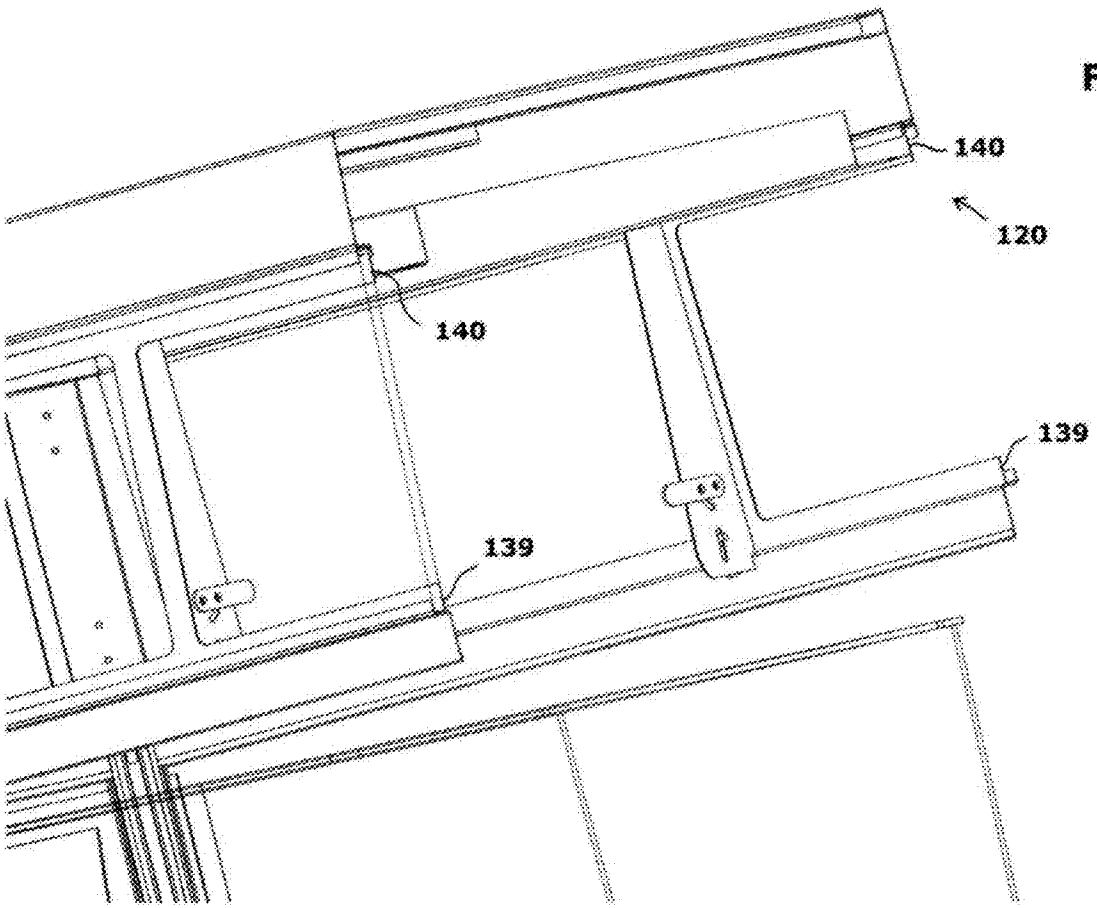
FIG. 11 shows a schematic view of a part of the coffin according to the invention.

Coffin 100 may comprise at side walls and end walls of lid part 120 receiving means 139, 140, as shown in FIG. 11. In receiving means 139, 140, wall panels may be inserted so as to customize coffin 100. Side wall panels may be inserted from an end portion of said receiving means 139, 140. Exchangeable wall panels allow providing an individualized coffin.

Figure 12:
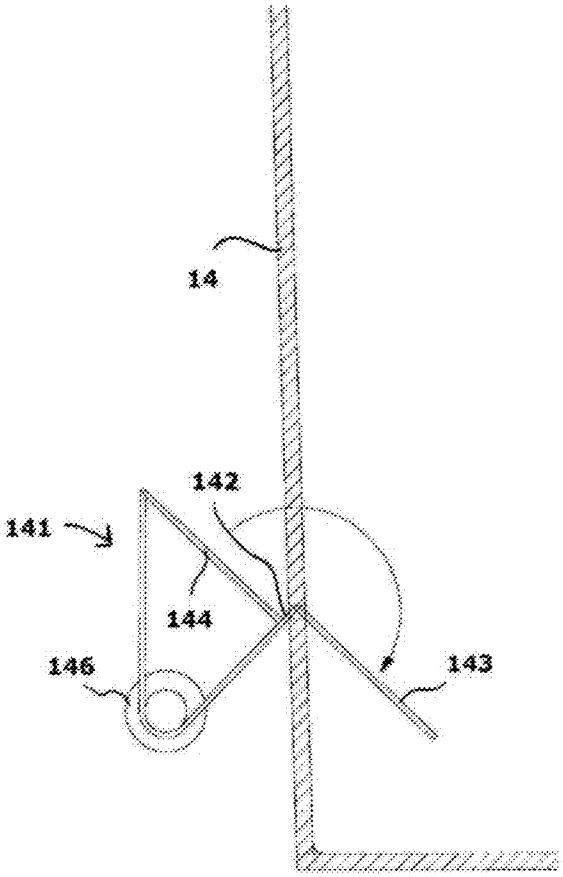
FIG. 12 and FIG. 13 show consecutive steps of positioning a handle in de inner coffin.
Figure 13:
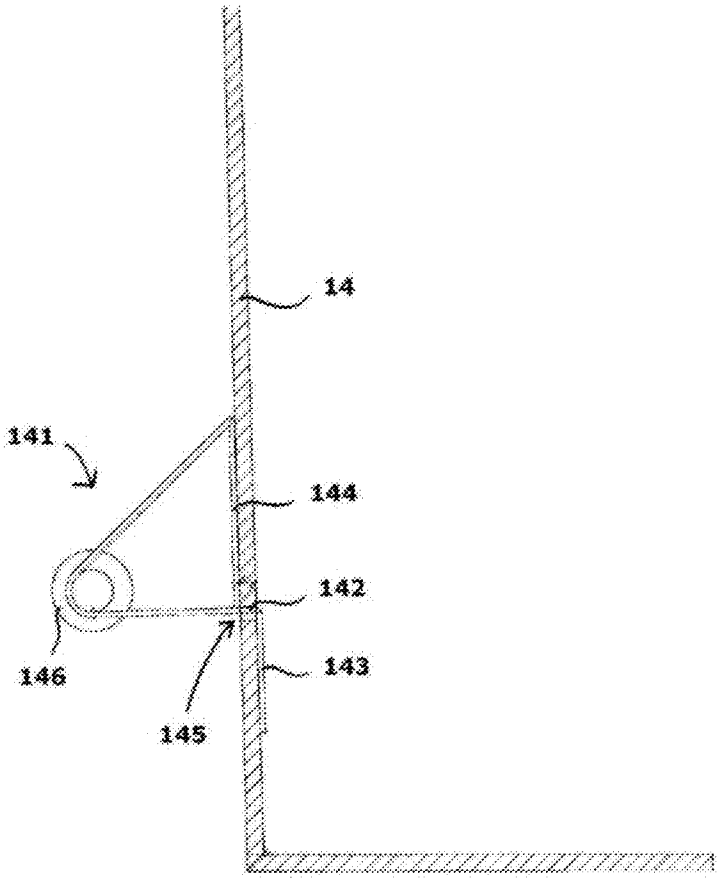

FIG. 12 and FIG. 13 show consecutive steps of positioning a handle 141 in a wall 14 of inner coffin 10, said handle 141 being embodied with a central body 142, a first body part 143 extending from said central body 142 in a first plane therefrom in a first direction and a second body part 144 extending from said central body 142 in a second plane therefrom and in a second, opposite direction, said first and second plane being parallel and spaced apart at a distance substantially equal to the thickness of said coffin's wall 14, said first body part 143 being designed to be inserted from the outside of said inner coffin through a hole 145 in a wall of said inner coffin, such that said central body 142 is positioned in said hole 145, said first body part 143 being positioned against said coffin wall 14 at its inside and said second body part 144 being positioned against said coffin wall 14 at its outside and said grip 146 being positioned at a distance from said coffin wall 14 at its outside.

Figure 14:
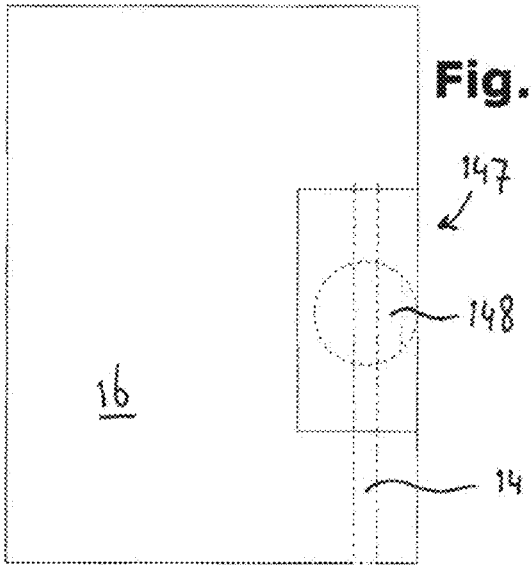
FIG. 14 shows a schematic top view of a clip for closing a lid to the inner coffin.
Figure 15:
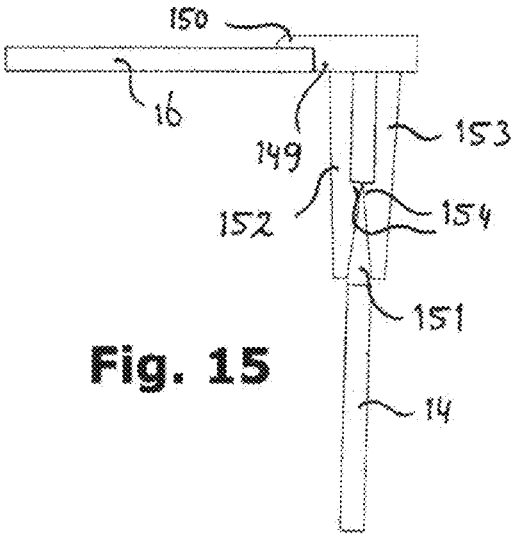
FIG. 15 shows a schematic side view of the functioning of the clip.
Figure 16:
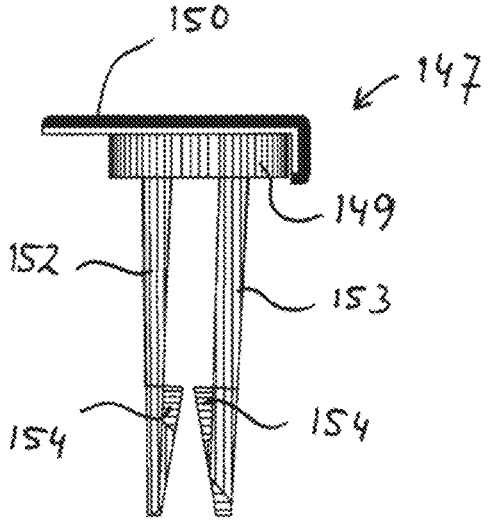
FIG. 16 shows a schematic side view of a clip according to FIG. 14 and FIG. 15.

FIG. 14 shows a schematic top view of a means 147 for connecting lid 16 of inner coffin 10 to side wall 14 of said inner coffin 10. Said means is configured as a clip 147. The use of clip 147 is also identified in FIG. 15 in a partial side view. FIG. 16 shows a schematic side view of clip 147.

In FIG. 14, side wall 14 has been partially identified by means of a dotted line. In lid 16, a through hole 148 has been provided, in which a receiving part 149 of clip 147 is received. Top part 150 of said clip 147 extends along the surface of lid 16 that is directed away from side wall 14. As mentioned before, said inner coffin 10 comprises a base (also mentioned bottom) 11 and walls 12, 13, 14, 15, said inner coffin being closed off by a lid 16. The lid 16 comprises a through hole 148 covering part of wall 14 and extends at both sides of said wall 14. Said wall 14 comprises a recess 151, in the embodiment shown in FIG. 15 as a through hole 151, at a position below said through hole 148 in said lid 16. The clip 147 being positionable in said through hole 148, wherein top part 150, as main body part, of said clip 147 is positioned on said lid 16 directed away from said wall 14. Said clip 147 further comprises two parallel legs 152, 153 and protrusions 154 at each leg 152, 153, such that when inserted in said lid's 16 hole 148, said legs 152, 153 are positioned against opposite sides of said wall 14, said protrusions 154 being at least partly received within said recess 151.

Various other embodiments of the invention will be apparent to the skilled person when having read the above disclosure in connection with the drawing, all of which are within the scope of the invention and accompanying claims. The invention also relates to all combinations of separate features described in the text and shown in the drawings.

The invention claimed is:

1. A coffin for holding mortal remains of a deceased person, the coffin being constructed to cover an inner coffin constructed for holding the mortal remains therein or thereon, the inner coffin having a bottom, opposing first and second ends and opposing first and second sides extending in a longitudinal direction of the inner coffin between the first and second ends, the coffin comprising:

a cover constructed and arranged such as to provide at least partial covering of the inner coffin, wherein the cover is translatable in an upward direction with respect to a base;

wherein the cover comprises a means for receiving exchangeable side wall panels, at least partially positioned at at least one of opposing first and second ends and opposing first and second sides extending in a longitudinal direction of the inner coffin between said first and second ends, wherein said means for receiving are comprised of U-shaped ducts, a first duct being provided at a position close to the base and another duct being positioned at a top side further away from the base, such that openings of said ducts are directed towards each other for receiving a respective said exchangeable side wall panel.

2. The coffin according to claim 1, wherein the base is provided with a roller arrangement constructed and arranged to allow displacement of the inner coffin with respect to the base.

3. The coffin according to claim 1, wherein at least one of the base and the cover comprises a cooling element holding arrangement for holding cooling elements for cooling of the mortal remains.

4. The coffin according to preceding claim 1, wherein at least one of the base and the cover comprises cooling elements for cooling of the mortal remains.

5. The coffin according to claim 1, said base comprising near an end an elevation, said inner coffin comprising at its corresponding end an elevated bottom portion, such that the bottom side of the inner coffin is supported by the base.

6. The coffin according to claim 1, said inner coffin provided with handles, wherein said coffin's opposing first and second ends or said coffin's opposing first and second sides are provided with slotted holes, said handles being embodied with a central body, a first body part extending from said central body in a first plane therefrom in a first direction and a second body part extending from said central body in a second plane therefrom and in a second, opposite direction, said first and second plane being parallel and spaced apart at a distance substantially equal to the thickness of said coffin's wall, said first body part being designed to be inserted from the outside of said inner coffin through said hole, such that said central body is positioned in said hole, said first body part being positioned against said coffin wall at its inside and said second body part being positioned against said coffin wall at its outside and a grip being positioned at a distance from said coffin wall at its outside.

7. The coffin according to claim 6, wherein said first body part is positioned at a position closer to the base than said second body part.

8. The coffin according to claim 1, wherein said inner coffin comprises a base and walls, said inner coffin being closed off by a lid, said lid comprising a through hole covering at least part of one of said coffin's walls and extending at both sides of said wall, said wall comprising a recess at a position below said through hole in said lid, a retaining clip being positionable in said through hole, wherein a main body part of said clip is positioned on said lid directed away from said wall, said retaining clip further comprising two parallel legs and protrusions at each leg, such that when inserted in said lid's hole, said legs are positioned against opposite sides of said wall, said protrusions being at least partly received within said recesses.

* * * * *